US010301164B2

(12) United States Patent
Jordan et al.

(10) Patent No.: US 10,301,164 B2
(45) Date of Patent: May 28, 2019

(54) PRESSURIZED COUNTER-TOP BEVERAGE DISPENSING SYSTEM

(71) Applicants: Brett LeBeau Jordan, San Francisco, CA (US); John Stevenson Patrick, Redondo Beach, CA (US); David Patrick Stringer, Palo Alto, CA (US); Katalin Gera Myrick, San Francisco, CA (US)

(72) Inventors: Brett LeBeau Jordan, San Francisco, CA (US); John Stevenson Patrick, Redondo Beach, CA (US); David Patrick Stringer, Palo Alto, CA (US); Katalin Gera Myrick, San Francisco, CA (US)

( * ) Notice: Subject to any disclaimer, the term of this patent is extended or adjusted under 35 U.S.C. 154(b) by 0 days.

(21) Appl. No.: 15/732,336

(22) Filed: Oct. 26, 2017

(65) Prior Publication Data

US 2018/0118549 A1 May 3, 2018

Related U.S. Application Data

(60) Provisional application No. 62/496,789, filed on Oct. 27, 2016.

(51) Int. Cl.
*B67D 1/04* (2006.01)
*B67D 1/00* (2006.01)
(Continued)

(52) U.S. Cl.
CPC ..... *B67D 1/0418* (2013.01); *B67D 1/0004* (2013.01); *B67D 1/0406* (2013.01); *B67D 1/06* (2013.01); *B67D 1/0804* (2013.01); *B67D 1/0857* (2013.01); *B67D 1/0895* (2013.01); *B67D 1/0869* (2013.01); *B67D 1/16* (2013.01); *B67D 2001/0092* (2013.01);
(Continued)

(58) Field of Classification Search
CPC .. B67D 1/0418; B67D 1/0004; B67D 1/0406; B67D 1/06; B67D 1/084; B67D 1/0857; B67D 1/0895; B67D 1/16; B67D 1/0869; B67D 2001/0098; B67D 2001/0092; B67D 2001/0481; B67D 2001/0487; B67D 2001/0822; B67D 2210/00099
USPC ..... 222/146.1, 146.6, 309, 399, 401
See application file for complete search history.

(56) References Cited

U.S. PATENT DOCUMENTS 6,082,589 A * 7/2000 Ash ..... B67D 1/04 222/146.6
6,378,740 B1 * 4/2002 Martin ..... B67D 1/04 222/334
(Continued)

*Primary Examiner* — Lien M Ngo
(74) *Attorney, Agent, or Firm* — James A. Gavney, Jr.; JAG Patent Services

(57) ABSTRACT

A portable beverage dispensing system is disclosed. The portable beverage dispensing system includes a reservoir container with an internal volume for holding a beverage. The beverage dispensing system also includes a pressure unit accessory and a dispensing mechanism accessory that detachably and interchangeably attached to accessory attachments on the reservoir container that are in fluid communication with the internal volume of the reservoir container. The pressure unit accessory includes a pressure regulator and a removable gas canister for pressurizing the reservoir container and dispensing the beverage through the dispensing mechanism accessory.

18 Claims, 10 Drawing Sheets

(51) Int. Cl.
*B67D 1/08* (2006.01)
*B67D 1/06* (2006.01)
*B67D 1/16* (2006.01)

(52) U.S. Cl.
CPC ..... *B67D 2001/0098* (2013.01); *B67D 2001/0481* (2013.01); *B67D 2001/0487* (2013.01); *B67D 2001/0822* (2013.01); *B67D 2210/00099* (2013.01)

(56) References Cited

U.S. PATENT DOCUMENTS

| | | | | |
|---|---|---|---|---|
| 6,783,034 | B1 * | 8/2004 | Brent | B67D 1/0418 222/183 |
| 2011/0042487 | A1 * | 2/2011 | Cai | A01G 25/145 239/332 |
| 2013/0264360 | A1 * | 10/2013 | Astolfi | B67D 1/0418 222/399 |

* cited by examiner

PRESSURIZED COUNTER-TOP BEVERAGE DISPENSING SYSTEM

RELATED APPLICATION

This application claims priority under 35 U.S.C. § 119(e) from the U.S. provisional patent application Ser. No. 62/496,789, filed on Oct. 27, 2016, and titled "PRESSURIZED COUNTER-TOP BEVERAGE DISPENSING SYSTEM." The provisional patent application Ser. No. 62/496,789, filed on Oct. 27, 2016, and titled "PRESSURIZED COUNTER-TOP BEVERAGE DISPENSING SYSTEM" is hereby incorporated by reference.

FIELD OF THE INVENTION

This invention relates to beverage dispensing systems. More particularly, the present invention relates pressurized counter-top beverage dispensing systems.

BACKGROUND OF THE INVENTION

Beverages are often dispensed through keg-like dispensing systems. Typically, kegs are artificially pressurized with carbon dioxide, nitrogen or a mixture of carbon dioxide and nitrogen.

Keg beer has replaced traditional cask ale because keg beer requires less care to handle. Pressurized carbon dioxide maintains carbonation in the beer being dispensed. The carbon dioxide pressure varies depending on the amount of carbon dioxide already in the beer and the keg storage temperature. Occasionally, keg beer is pressurized with carbon dioxide blended with nitrogen to allow a higher operating pressures in complex dispensing systems. The kegs themselves are typically large barrel-like containers and traditional pressurized keg dispensing systems are not suitable for dispensing smaller qualities of beer or other beverages. Further traditional pressurized keg dispensing systems are limited to use with carbon dioxide, nitrogen and/or combinations thereof.

SUMMARY OF INVENTION

The present invention is directed to a beverage dispensing system. The beverage dispensing system of the present invention is preferably small enough to be portable and fit on top of a counter and/or on a standard refrigerator shelf. In a preferred embodiment of the invention the beverage dispensing system can fit within a standard dishwasher and is approximately the height of a gallon container of milk.

The beverage dispensing system of the present invention includes a reservoir container with an internal volume for holding a beverage. The reservoir container can have any number of shapes, but preferably has a substantially flat bottom surface for supporting the beverage dispensing system in an upright position on a surface, such as a counter top or a refrigerator shelf. The reservoir container can be formed from any suitable material or combinations of materials, but is preferably formed from stainless steel. The reservoir container or portions of the reservoir container walls can be insulated and/or have a double wall vacuum sealed structure to keep a beverage contained therein hot or cold.

The reservoir container preferably has an internal volume of five gallons or less and more preferably has an internal volume of between one to three gallons. Regardless of the shape or size of the reservoir container, the reservoir container is configured to have accessories attached to the reservoir container that are in fluid communication with the internal volume of the reservoir container. The reservoir container also has filling aperture, preferably through a top surface of the reservoir container, with a re-sealable cover for filling the internal volume of the reservoir container with a beverage.

In accordance with the embodiment of the invention the beverage dispensing system includes a pressure unit accessory that detachably couples to the reservoir container. The pressure unit accessory includes a pressure regulator with a valve for controlling pressure within the internal volume of the reservoir container and a detachable or replaceable gas canister to supply a pressurizing gas into the internal volume of the reservoir container. The gas canister is configured to be recharged with the pressurizing gas or replaced with a new gas canister after the gas within the old gas canister has been used up. The gas canister can be charged with carbon dioxide, argon, nitrogen, air or any other non-toxic consumable gas or mixture of gasses. The gas can be used to preserver the beverage contained within the internal volume of the reservoir container, add flavor to the beverage contained within the internal volume of the reservoir container or infuse the beverage contained within the internal volume of the reservoir container with the gas.

The beverage dispensing system of the present invention also includes dispensing mechanism accessory. The dispensing mechanism accessory can, for example, include a valve, a facet feature or a tap structure with a tap handle with a dispensing spout. The dispensing mechanism accessory allows for the controllable release of servings of the beverage from the reservoir container when the internal volume of the reservoir container is pressurized by the pressure unit accessory.

The accessories, such as the a pressure unit accessory and the dispensing mechanism accessory, are preferably coupled to the reservoir container through accessory adapters. The accessory adapters are, for example, male pipe fittings that protrude vertically from a self surface of the reservoir container with the reservoir container in an upright position. The male pipe fittings are threaded into matched thread holes on the shelf surface of the reservoir container and provides the structure for attaching the accessories. Preferably, the beverage dispensing system of the present invention has two accessory adapters and the pressure unit accessory and the dispensing mechanism accessory can be interchangeably attached to either of the two accessory adapters.

In operation, the beverage system is assembled by placing female portions of the accessories over the male portions of the accessory adapters. O-rings around the male portions of the accessory adapters provide pressure seals and prevent liquid from leaking out or gas from escaping from spaces between the accessories and the accessory adapters. The accessories are then secured to the male portions of the accessory adapters through allen screws or nuts that thread into holes on top of the male portions of the accessory adapters.

Where the accessories used are a pressure unit accessory and a dispensing mechanism accessory, such as described above, a suitable beverage is placed within the internal volume of the reservoir container through the filling aperture and the re-sealable cover is places in a closed position and secure or sealed with a clip or clamp. The valve on the pressure unit accessory is open to reach the desired pressure within the reservoir container and the beverage is dispensed through the dispensing mechanism accessory after a suitable period of time.

The beverage dispensing mechanism is equipped with any number of handle features for transporting the beverage dispensing system. The handles are fixed handles, removable handles, extendable handles, folding handles and/or combinations thereof. The beverage system can also be equipped with a thermo-regulator for heating or cooling the beverage within the reservoir container. The thermo-regulator can be within the internal volume of the reservoir container or attach to an external wall of the reservoir container. The thermo-regulator is powered through a power chord or through a battery. Where the thermo-regulator is a free convection thermoelectric cooler, an AC/DC converter is required or attentively the free convection thermoelectric cooler can be battery powered.

In accordance with an embodiment of the invention, the beverages dispensing system has a substantially rectangular shaped reservoir container. The substantially rectangular shaped reservoir container has an overall length of between 10 and 16 inches, an overall height of between 9 and 14 inches, an overall width of between 4 and 8 inches and has contoured L-shaped side surfaces that define a self structure. The self structure is preferably as wide as the overall width of the reservoir container and has a depth of between 2 to 4 inches.

DETAILED DESCRIPTION OF THE INVENTION

Figure 1:
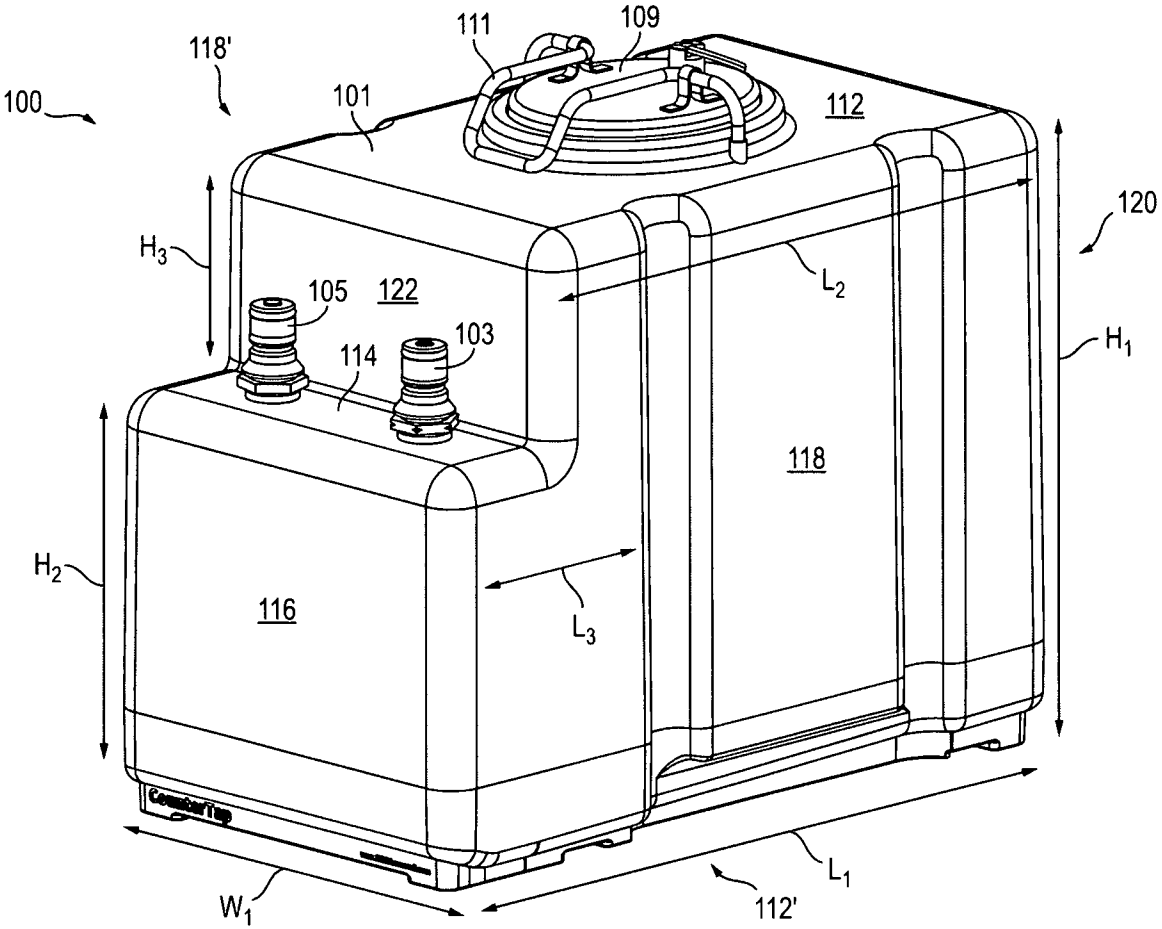
FIG. 1 shows a representations of a reservoir container with accessory adapters used in the beverage dispensing system of the present invention.

Referring to FIG. 1, a beverage dispensing system 100 of the present inventions includes a reservoir container 101 for holding a beverage. The reservoir container 101 is substantially rectangular with a back wall 120, a front wall 116, a depressed or indented front wall 122, a top surface 112, a bottom surface 112' and side walls 118 and 118'. The bottom surface 112' is preferably flat so that the reservoir container 101 can rest on a counter top or on a self within a refrigerator.

The overall length $L_1$ of the reservoir container 101 is between 10 and 16 inches, the overall height $H_1$ of the reservoir container 101 is between 9 and 14 inches, the overall width $W_1$ of the reservoir container 101 is between 4 and 8 inches. The side walls 118 and 118' of the reservoir container 101 are contoured and L-shaped, such that the front surfaces 122 and 116 form a self structure 114. The shelf structure 114, preferably is approximately as wide as the overall width $W_1$ of the reservoir container 101 and preferably has a depth $L_3$ of between 2 to 4 inches. The combined height $H_2$ of the front wall 116 and the height $H_3$ of the depressed or indented front wall 122 is approximately equal to the overall height $H_1$. The reservoir container 101 or portions of the reservoir container walls 112, 112', 118, 118' 120, 116 and 122 can be insulated or have a double wall vacuum sealed structures to keep a beverage contained within the reservoir container 101 hot or cold.

Regardless of the shape of the reservoir container 101, the reservoir container 101 preferably has an internal volume of five gallons or less and more preferably has an internal volume of between one to three gallons. The reservoir container 101 can be formed from any suitable material by is preferably formed from stainless steel and includes at least two accessory adapters 103 and 105 for attaching a accessories. The accessory adapters 101 and 105 and the accessories attached thereto are in fluid communication with the internal volume of the reservoir container 101. The reservoir container 101 also has filling aperture on the top surface 112 for filling the internal volume of the reservoir container 101 with a beverage and the aperture is closed or sealed with a with a re-sealable cover 109 through a securing clamp 111.

Figure 2A:
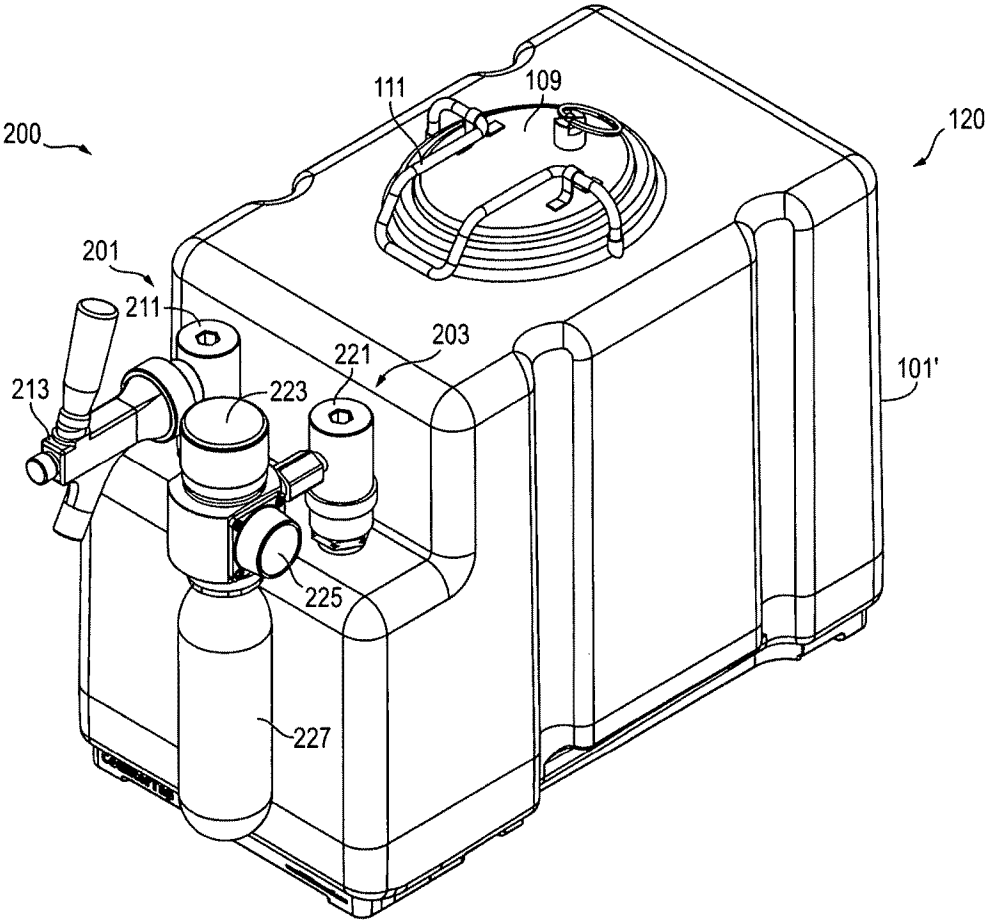
FIGS. 2A-B show representations of a beverage dispensing system with a pressure unit accessory and a dispensing mechanism accessory attached to a reservoir container through accessory adapters, in accordance with the embodiments of the invention.
Figure 2B:
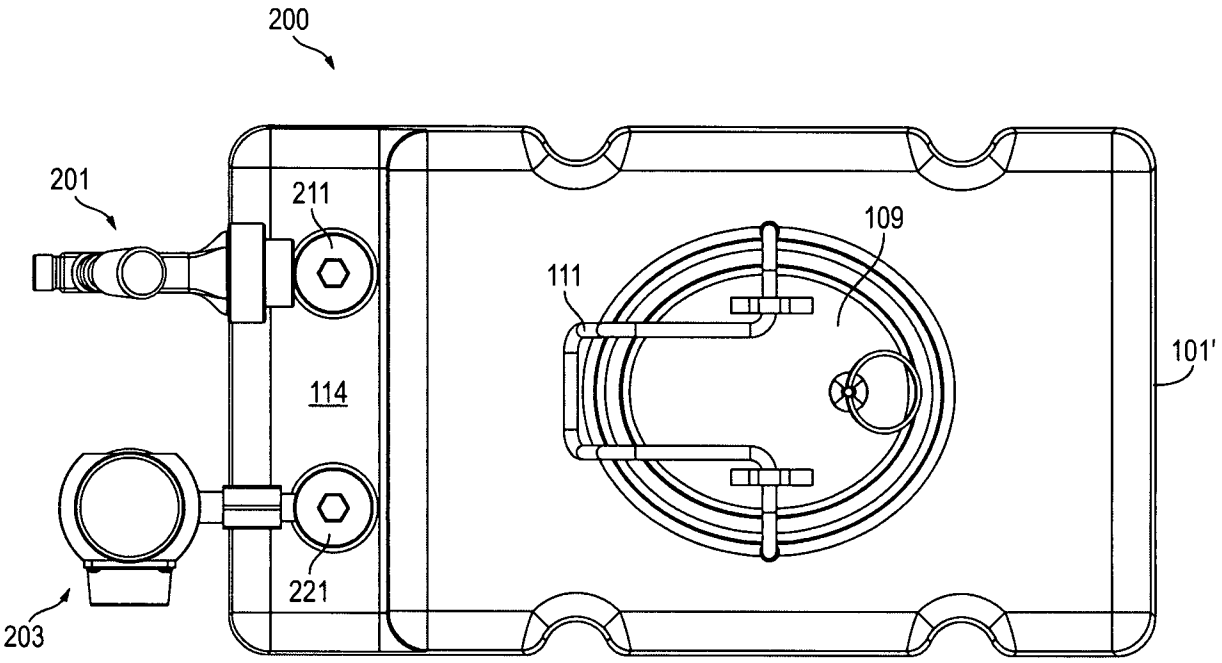

FIGS. 2A-B show views of a beverage dispensing system 200, having a reservoir container 101' such as the reservoir container 101 (FIG. 1) described above. The reservoir container 101' includes a re-sealable cover 109 and a securing clamp 111. In this embodiment, a pressure unit accessory 203 and a dispensing mechanism accessory 201 are attached to the reservoir container 101' through the accessory adapters 103 and 105 (FIG. 1).

The accessory adapter 103 and 105 are, for example, male pipe fittings that protrude vertically from the self surface 114 of the reservoir container 101' with the reservoir container 101' in an upright position. The male pipe fittings are threaded into matched thread holes on the self surface 114 of the reservoir container 101' or are otherwise secured to or attached to the self surface 114 of the reservoir container 101'. The accessory adapters 103 and 105 provide the structure for attaching the accessories. Preferably, the beverage dispensing system 200 of the present invention has a pressure unit accessory 203 and a dispensing mechanism accessory 201 that can be interchangeably attached to either of the two accessory adapters 103 and 105.

In operation, the beverage dispensing system 200 is assembled by placing female portions of the accessories 201 and 202 over the male portions of the accessory adapters 103 and 105. O-rings around the male portions of the accessory adapters 103 and 105 provide a pressure seal and prevents liquid or gas from leaking out from spaces between the accessories 201 and 203 and the accessory adapters 103 and 105. The accessories 201 and 203 are then secured to the male portions of the accessory adapters 103 and 105 through allen screws or nuts 211 and 221 threaded into holes on top of the male portions of the accessory adapters 103 and 105.

The pressure unit accessory 203 includes a pressure regulator 225 with a valve 223 for controlling pressure within the internal volume of the reservoir container 101' and a detachable or replaceable gas canister 227 to supply a pressurizing gas into the internal volume of the reservoir container 101'. The gas canister 227 is configured to be recharged with the pressurizing gas or replaced with a new gas canister after the gas within the old gas canister has been used up. The gas canister 227 can be charged with carbon dioxide, argon, nitrogen, air or any other non-toxic consumable gas. The gas can be used to preserver the beverage contained within the internal volume of the reservoir container 101', add flavor to the beverage contained within the internal volume of the reservoir container 101' or infuse the beverage contained within the internal volume of the reservoir container 101' with the gas.

The dispensing mechanism accessory 201 of the present invention is valve, facet feature or a tap 213 with a tap handle with a dispensing spout. The dispensing mechanism accessory 201 is used to controllably release servings of the beverage from the reservoir container 101' when the internal volume of the reservoir container 101' is pressurized by the pressure unit accessory 203.

Figure 3A:
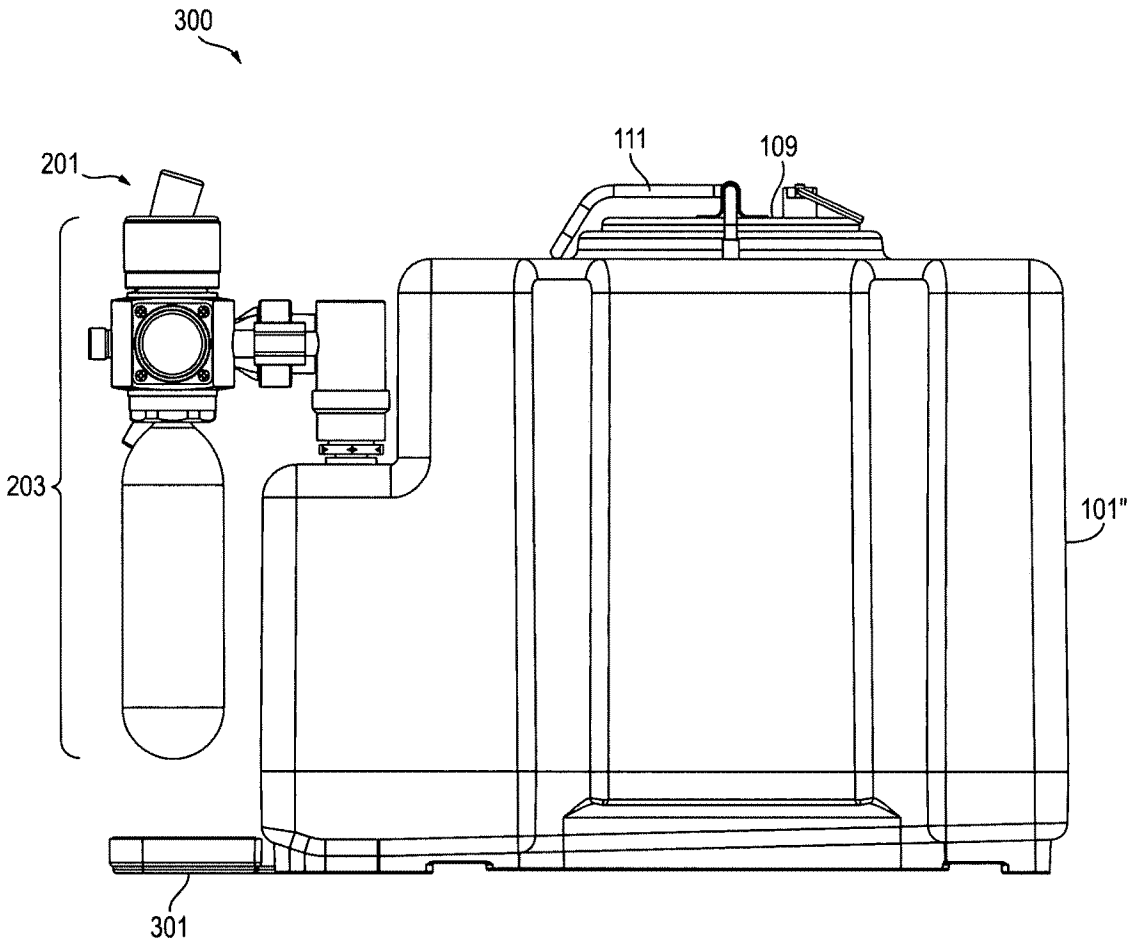
FIGS. 3A-B show views of a beverage dispensing system with a detachable dispensing tray, in accordance with the embodiments of the invention.
Figure 3B:
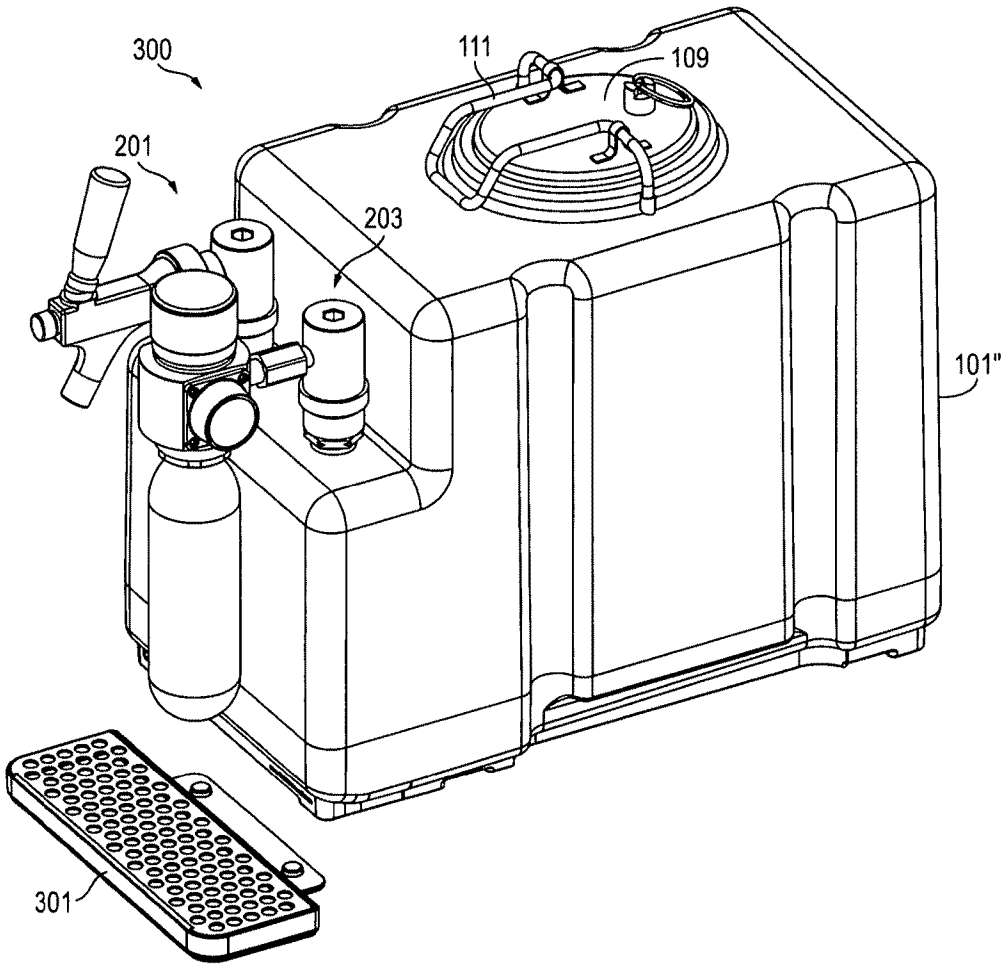
Figure 4A:
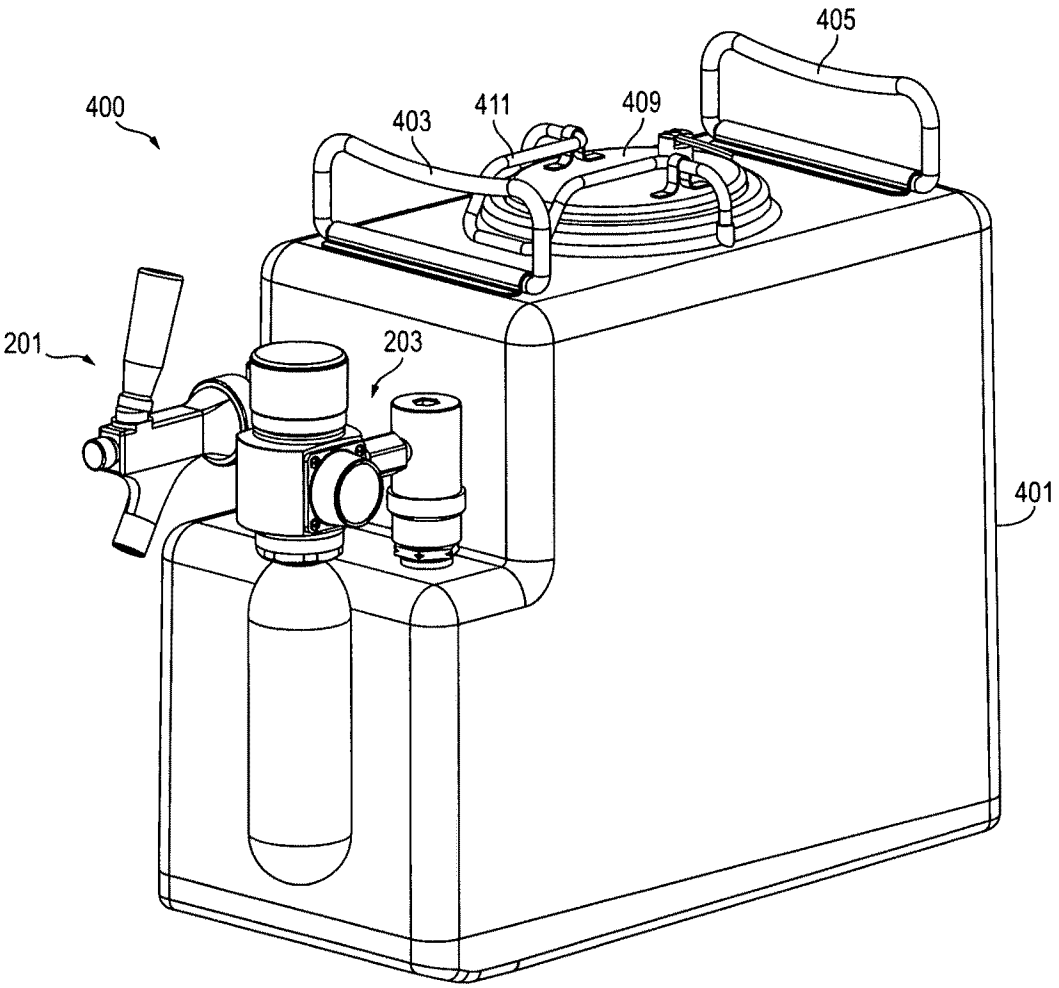
FIGS. 4A-D show views of beverage dispensing systems with different handle configurations, in accordance with the embodiments of the invention.
Figure 4B:
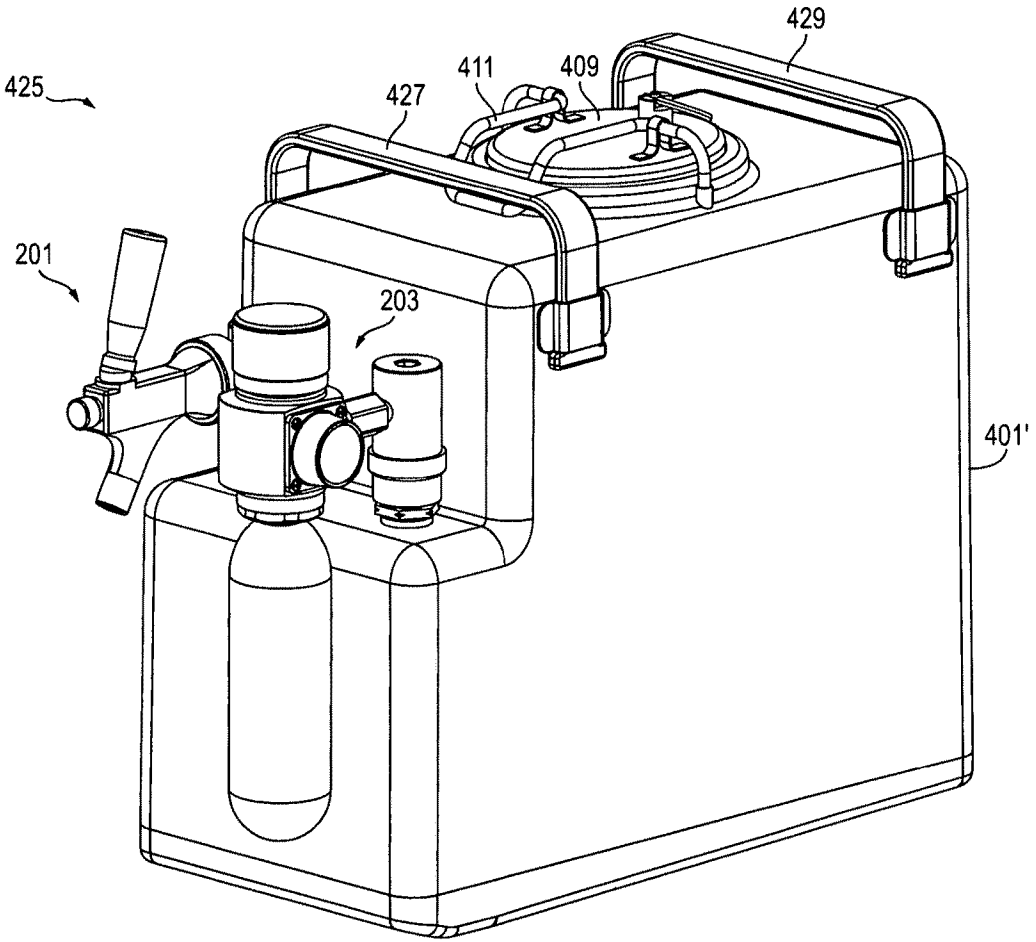
Figure 4C:
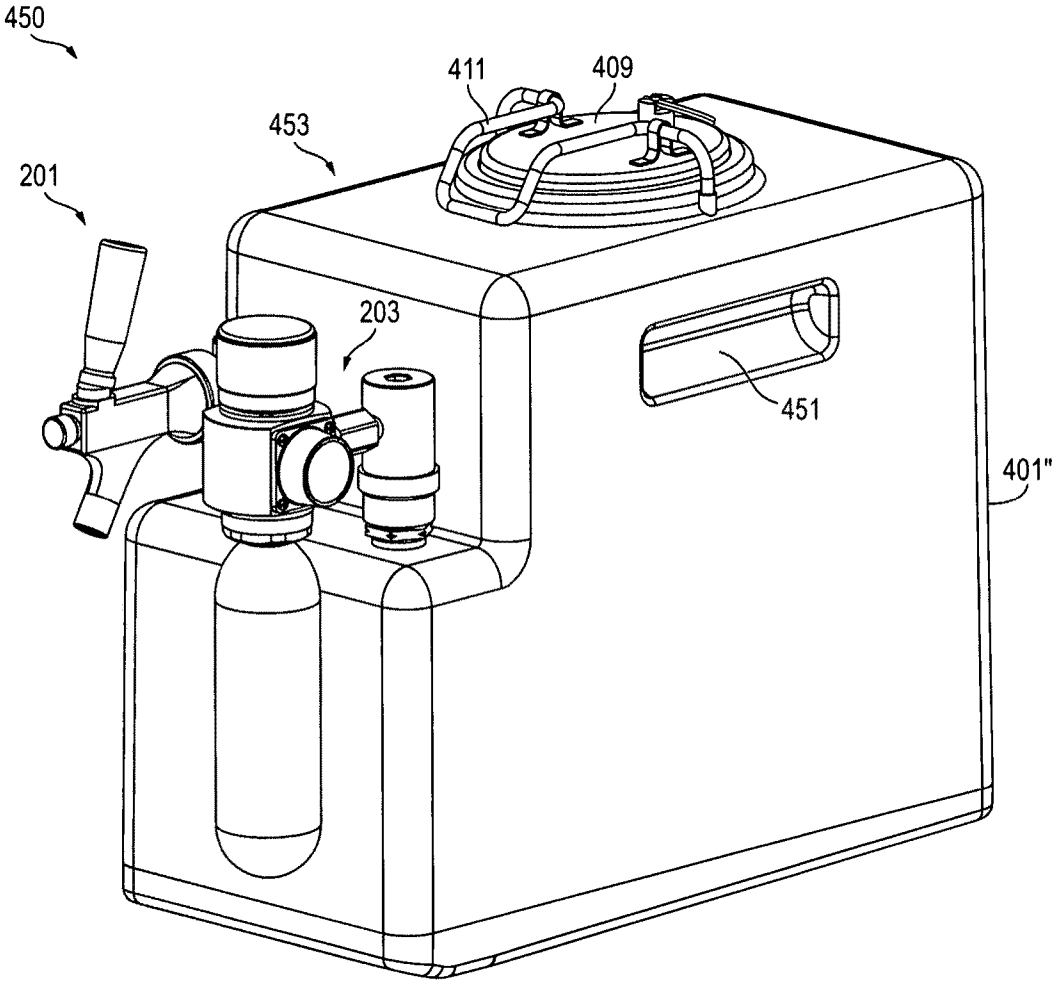
Figure 4D:
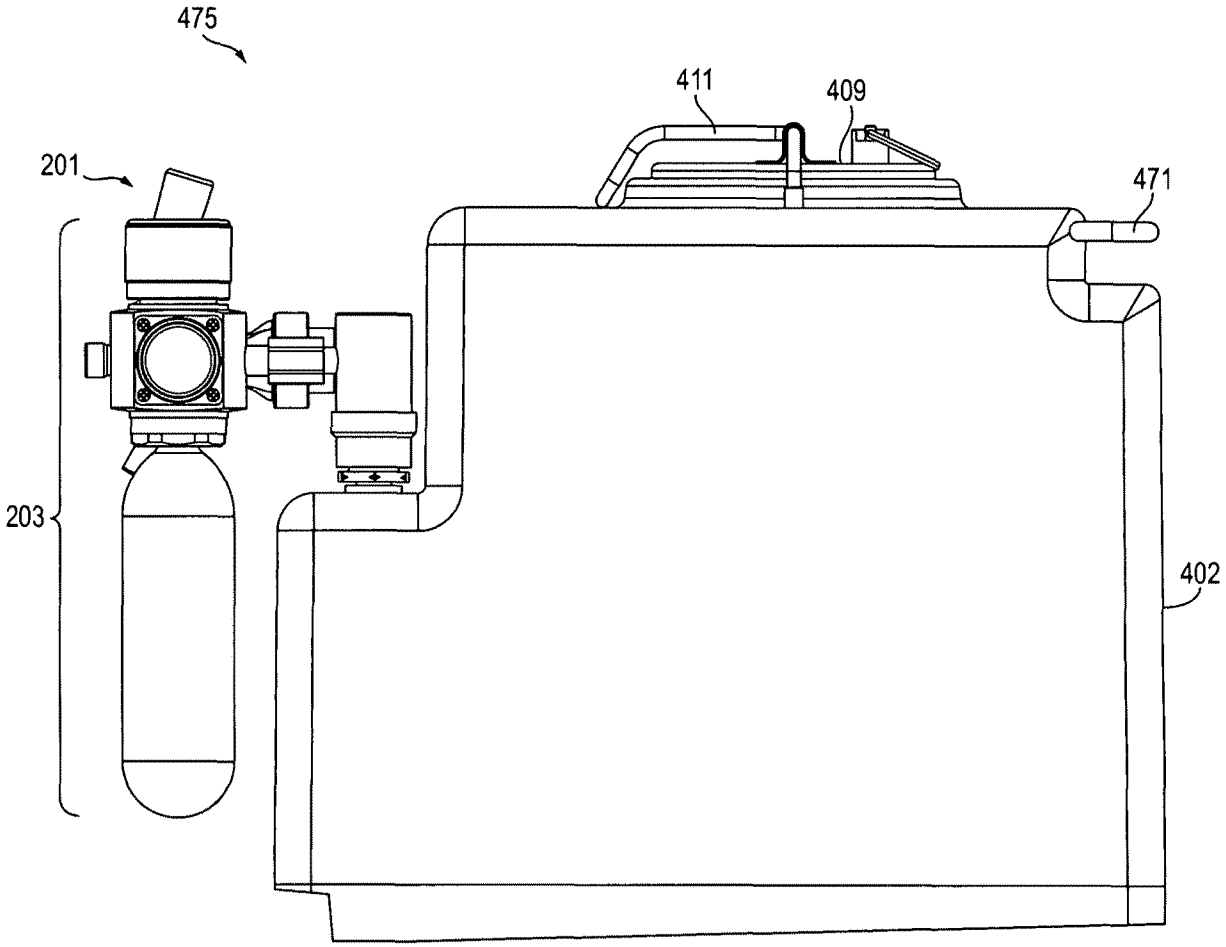

FIGS. 3A-B show views of a beverage dispensing system 300 with a detachable dispensing tray 301. The dispensing system 300 includes a reservoir container 101", such as the reservoir containers 100 and 101' described above with reference to FIG. 1 and FIGS. 2A-B. The beverage dispensing system 300 also includes a re-sealable cover 109, a securing clamp 111, a dispensing mechanism accessory 201 and a pressure unit accessory 203, also described above with reference to FIG. 1 and FIGS. 2A-B.

FIGS. 4A-D show views of beverage dispensing systems 400, 425, 450 and 475 with different handle configurations. The beverage dispensing systems 400, 425, 450 and 475 have reservoir containers 401, 401', 401" and 402, similar to the reservoir containers 100, 101' and 100' described above with reference to FIG. 1, FIGS. 2A-B and FIGS. 3A-B. The beverage dispensing systems 400, 425, 450 and 475 all have a re-sealable cover 409, a securing clamp 411, a dispensing mechanism accessory 201 and a pressure unit accessory 203, also described above with reference to FIG. 1 and FIGS. 2A-B. The beverage dispensing systems 400 includes two folding handles 403 and 405 attached to a top surface 112 (FIG. 1) of the reservoir container 401; the dispensing systems 425 includes two collapsible handles 427 and 429 secures to side walls 118 and 118' (FIG. 1) of the reservoir container 401'; the beverage dispensing systems 450 includes insert or fixed handles 451 and 453 (not visible) on side walls 118 and 118' (FIG. 1) of the reservoir container 401"; and the beverage dispensing systems 475 includes a fixed bar handle 471 attached to a portion of a back wall 120 (FIG. 1) of the reservoir container 402. The handles 403, 405, 427, 429, 451, 453 and 471 are all configured to transport, lift or carry the beverage dispensing system the present invention.

Figure 5:
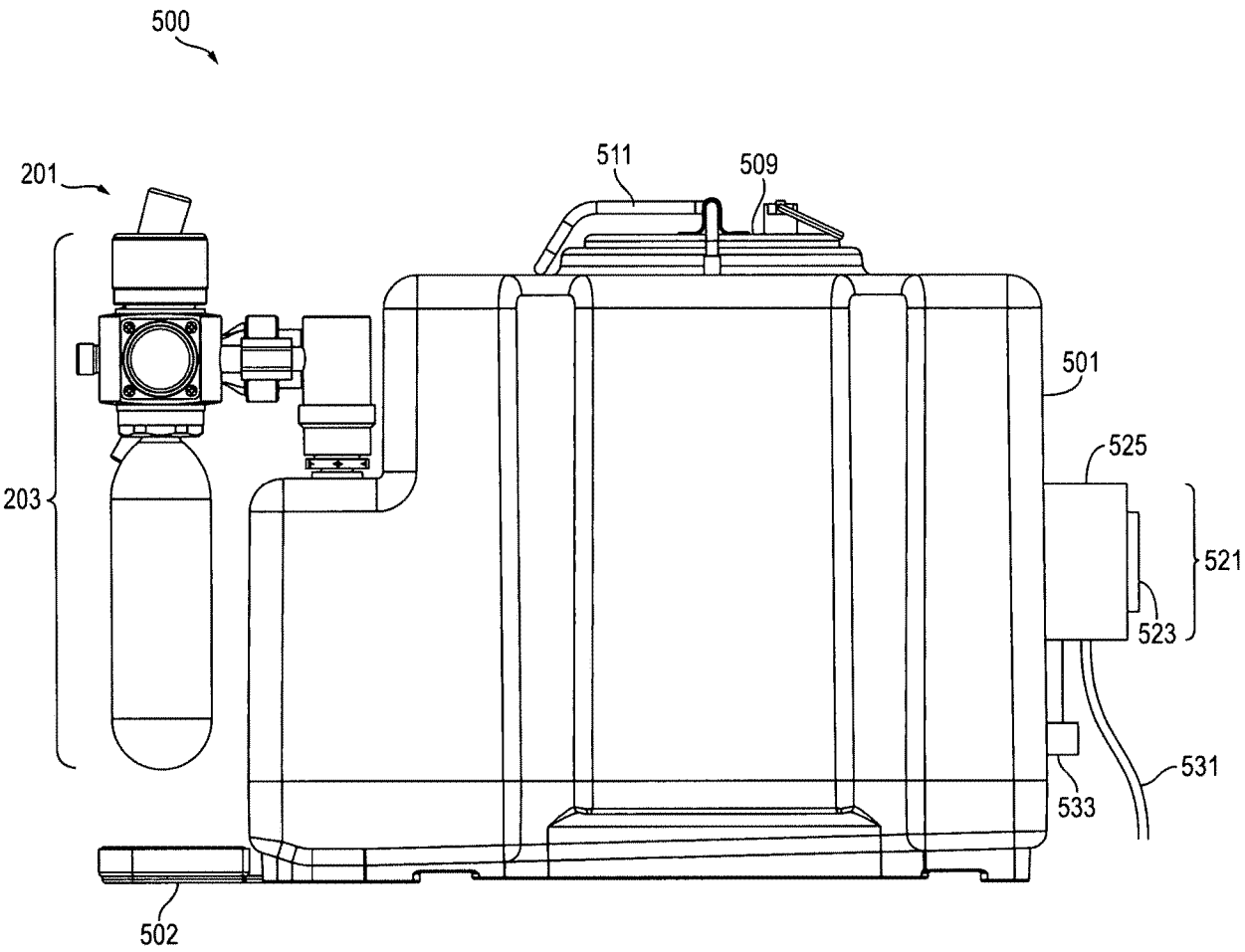
FIG. 5 shows a view of a beverage dispensing system with an external thermo-regulator attached to a wall of the reservoir container, in accordance with the embodiments of the invention.

FIG. 5 shows a view of a beverage dispensing system 500 with an external thermo-regulator 521 attached to a wall back wall 120 (FIG. 1) of a reservoir container 501. The reservoir container 501 of the beverage dispensing system 500 is similar to the reservoir containers 100, 101' and 100" described above with reference to FIG. 1, FIGS. 2A-B and FIGS. 3A-B. The beverage dispensing system 500 also has a re-sealable cover 509, a securing clamp 511, a dispensing mechanism accessory 201 and a pressure unit accessory 203, described above with reference to FIG. 1 and FIGS. 2A-B. The beverage dispensing system 500 also preferably includes a removable dispensing tray 502, such as the removable dispensing tray 301 described with reference to FIGS. 3A-B.

The thermo-regulator 521 includes a heating or cooling element 525, a regulator for setting the temperature and a feedback loop with sensor 533 for controlling the output of the thermo-regulator 521. The thermo-regulator 521 is any suitable thermo-regulator that is powered with a power cord 531 or a battery (not shown). In accordance with an embodiment of the invention the thermo-regulator 521 is a free convection thermoelectric cooler (Peltier cooler) with heat sink surface that couples to the reservoir container 501. Because free convection thermoelectric coolers are powered with DC current, a AC to DC converted is required to operate free convection thermoelectric coolers through a power chord 531. Alternatively, a free convection thermoelectric cooler can be powered with a battery. Regardless of the type of thermo-regulator 521 that is used, the thermo-regulator 521, is configured to control the temperature of a beverage contained within the internal volume of the reservoir container 501.

The present invention has been described in terms of specific embodiments incorporating details to facilitate the understanding of the principles of construction and operation of the invention. For example, the reservoir container can have any number of shapes including, but not limited to a circular shape, rectangular shape and other geometric shapes. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. A beverage dispensing system comprising:

a) a reservoir container with an internal volume for holding a beverage, the reservoir container having a substantially flat bottom surface for supporting the beverage dispensing system on a surface and an L-shaped front that provides a shelf surface;

b) accessory adapters protruding vertically from the shelf surface and being in fluid communication with the internal volume;

c) a re-sealable cover for filling the internal volume with a beverage;

d) a pressure unit that detachably and interchangeably couples to the accessory adapters for pressurizing the internal volume of the reservoir container; and e) a dispensing mechanism that detachably and interchangeably couples to of the accessory adapters for controllably releasing servings of the beverage from the reservoir container when the internal volume of the reservoir container is pressurized by the pressure unit.

2. The beverage dispensing system of claim 1, wherein the pressure unit includes a pressure regulator with a valve for controlling pressure within the internal volume of the reservoir container.

3. The beverage dispensing system of claim 2, wherein the pressure unit includes a detachable gas canister to supply a pressurizing gas into the internal volume of the reservoir container.

4. The beverage dispensing system of claim 1, wherein the reservoir container is formed from stainless steel.

5. The beverage dispensing system of claim 4, wherein walls or portions of the reservoir container are insulated.

6. The beverage dispensing system of claim 1, further comprising a thermo-regulator for heating or cooling the beverage within the reservoir container.

7. The beverage dispensing system of claim 6, wherein the thermo-regulator couples to an exterior wall of the container reservoir.

8. The beverage dispensing system of claim 7, wherein the thermo-regulator is a free convection thermoelectric cooler.

9. The beverage dispensing system of claim 1, wherein the internal volume of reservoir container is five gallons or less.

10. A beverage dispensing system comprising:

a) a stainless steel reservoir container for holding a beverage, the stainless steel reservoir container having an internal volume of less than five gallons and having accessory adapters protruding vertically from a shelf surface of an L-shaped front surface of the stainless steel reservoir container and a releasable top cover that are in fluid communication with the internal volume of the reservoir container;

b) a pressure unit that detachably and interchangeably couples to the accessory adapters for pressurizing the internal volume of the reservoir container; and c) a dispensing mechanism that detachably and interchangeably couples to the accessory adapters for controllably releasing of the beverage from the reservoir container with the internal volume of the reservoir container pressurized by the pressure unit; and d) a thermo-regulator for electrically heating or cooling the beverage within the reservoir container through a wall of the stainless steel reservoir container.

11. The beverage dispensing system of claim 10, wherein the internal volume of the reservoir container is between one and three gallons.

12. The beverage dispensing system of claim 10, wherein the pressure unit includes a pressure regulator with a valve for controlling pressure within the internal volume of the reservoir container and a detachable gas canister to supply a pressurizing gas into the internal volume of the reservoir container.

13. A beverage dispensing system comprising:

a) a reservoir container for holding a beverage, the reservoir container being substantially rectangular shaped with an overall length of between 10 and 16 inches, an overall height of between 9 and 14 inches, an overall width of between 4 and 8 inches and having a contoured L-shaped front surface that forms a shelf structure that is approximately as wide as the overall width of the reservoir container and has a depth of between 2 to 4 inches;

b) two accessory adapters that attach to two matches holes the surface of the shelf structure of the L-shaped front surface of the reservoir container to place the accessory adapters in fluid communication an internal volume of the reservoir container;

c) a pressure unit accessory that detachably and interchangeably couples to the two accessory adapters vertically for pressurizing the internal volume of the reservoir container;

d) a dispensing mechanism accessory that detachably and interchangeably couples to the two accessory adapters vertically for controlling releasing servings of the beverage from the reservoir container with the internal volume of the reservoir container pressurized by the pressure unit accessory; and e) a thermo-regulator for electrically heating or cooling the beverage within the reservoir container through a wall of the reservoir container.

14. The beverage dispensing system of claim 13, wherein the pressure unit accessory includes a pressure regulator with a valve for controlling pressure within the internal volume of the reservoir container and a detachable gas canister to supply a pressurizing gas into the internal volume of the reservoir container.

15. The beverage dispensing system of claim 13, wherein the dispensing mechanism accessory has a tap handle with a dispensing spout.

16. The beverage dispensing system of claim 13, wherein the internal volume of the reservoir container is less than five gallons.

17. The beverage dispensing system of claim 16, wherein the internal volume of the reservoir container is between one and three gallons.

18. The beverage dispensing system of claim 13, further comprising a releasable cover that covers an filling aperture on a top surface of the reservoir container for filling the internal volume with a beverage.

* * * * *